US005361557A

United States Patent [19]

Snyder et al.

[11] Patent Number: 5,361,557

[45] Date of Patent: Nov. 8, 1994

[54] OFFSETTING INTERLOCKING TIE-BACK ASSEMBLY

[75] Inventors: John N. Snyder, Bentleyville; Stanley A. Smith, Pittsburgh, both of Pa.

[73] Assignee: Indresco Inc., Dallas, Tex.

[21] Appl. No.: 69,027

[22] Filed: May 28, 1993

[51] Int. Cl.[5] ..... F27D 1/00

[52] U.S. Cl. ..... 52/608; 52/612; 52/604; 432/252; 432/298

[58] Field of Search ..... 52/603, 604, 605, 608, 52/609, 611, 612; 432/252, 248

[56] References Cited

U.S. PATENT DOCUMENTS

| | | | |
|---|---|---|---|
| 260,155 | 6/1882 | Beyerly . | |
| 308,577 | 11/1884 | Richards . | |
| 1,971,915 | 8/1934 | Mekler | 52/604 |
| 2,021,133 | 11/1935 | Munson | 52/604 |
| 3,315,950 | 4/1967 | Potocnik et al. | 432/252 |
| 3,630,503 | 12/1971 | Byrd, Jr. . | |
| 4,008,997 | 2/1977 | Krasl . | |
| 4,123,881 | 11/1978 | Muse | 52/611 |
| 4,317,418 | 3/1982 | Courshon, Jr. et al. | 432/252 |
| 4,436,144 | 3/1984 | Horak . | |
| 4,524,551 | 6/1985 | Schweiwiller | 52/608 |
| 4,896,999 | 1/1990 | Ruckstuhl | 52/604 |
| 4,900,249 | 2/1990 | McCollum et al. . | |
| 4,922,678 | 5/1990 | Scheiwiller | 52/604 |
| 4,940,081 | 7/1990 | Hyde . | |
| 5,154,032 | 10/1992 | Ritter | 52/605 |

FOREIGN PATENT DOCUMENTS

| | | | |
|---|---|---|---|
| 4014276 | 1/1992 | Germany | 432/252 |
| 0143284 | 8/1980 | Netherlands | 52/604 |

*Primary Examiner*—Carl D. Friedman
*Assistant Examiner*—Wynne E. Wood
*Attorney, Agent, or Firm*—John L. Sigalos

[57] ABSTRACT

A brick for use in a high temperature furnace, or the like, having a body portion with at least one tongue and groove pair in at least one of the body surfaces with anchor means formed integrally with the body portion. Tie-back brick assemblies are formed by mating at least two of such brick and clamping them together.

A lining for use in such furnaces is formed by using such tie-back assemblies with conventionally shaped brick.

8 Claims, 6 Drawing Sheets

Fig. 1
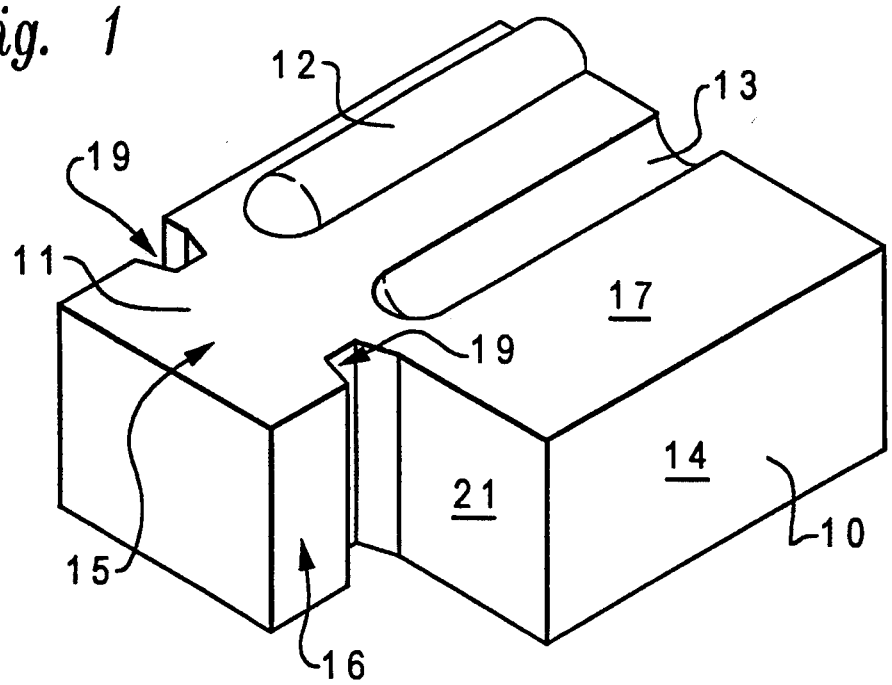
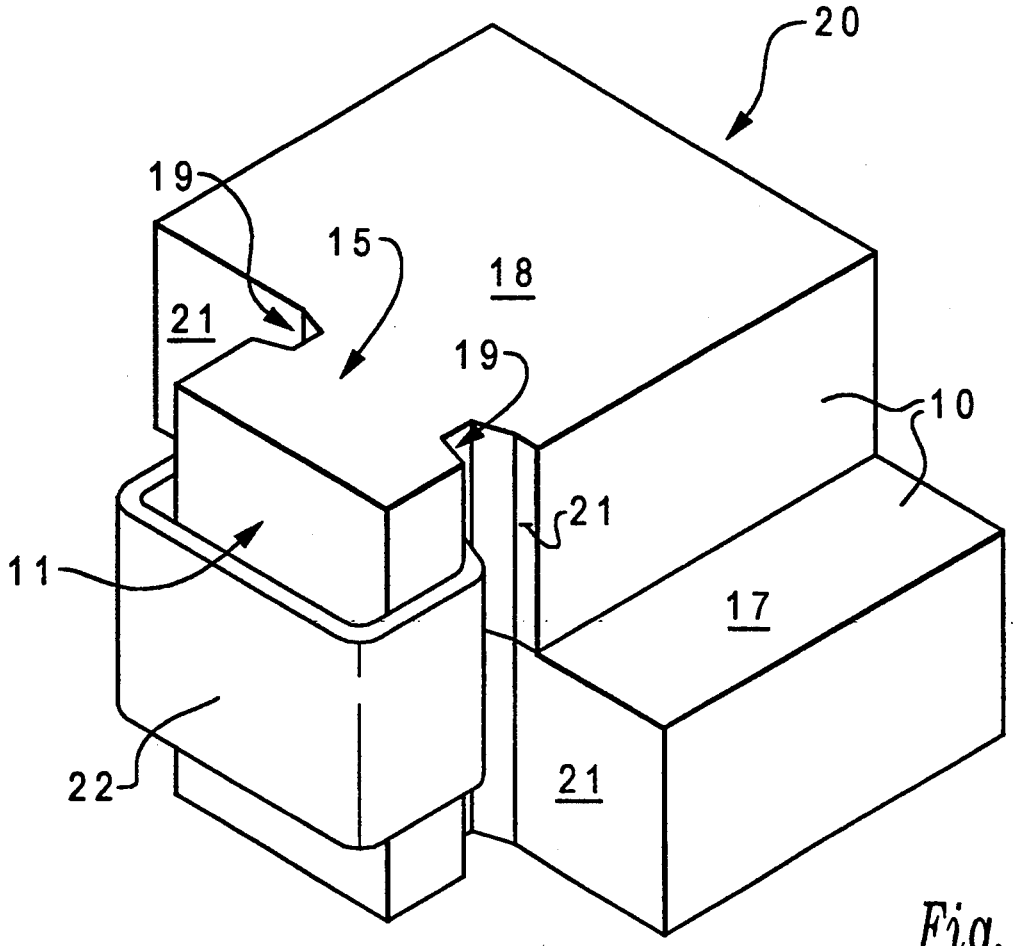
Fig. 2

OFFSETTING INTERLOCKING TIE-BACK ASSEMBLY

BACKGROUND OF THE INVENTION

This invention relates to brick and brick assemblies for use in a refractory lining wherein the lining is subject to thermal stresses which result in unwanted distortion of the lining.

Maintaining stability of refractory lining structures during the life of a furnace has been an age-old problem. Due to expansion of the refractory caused by heating and cooling or permanent growth caused by alteration of the refractory, a wall constructed of refractories tends to distort from the original dimensions. This often compromises the ability of the lining to contain molten metals or gases within the confines of the furnace. Numerous designs for interlocking brick have been devised to improve wall stability. Simple methods such as use of a common tongue and groove was first proposed in 1882 and was protected by U.S. Pat. No. 260,155. This concept was later expanded and applied to a complex structure as shown in U.S. Pat. No. 308,577. U.S. Pat. No. 4,008,997 illustrates a rather unique design for building a refractory box using individual members which have opposing male and female ends. Interlocking structures for refractory shapes designed to convey hot furnace gases are shown in U.S. Pat. Nos. 3,630,503, 4,436,144 and 4,940,081. These patents all show modification of the tongue and groove concept. The refractories interlock by a series of raised projections fitting into corresponding recesses. In all three cases, the brick are stacked in a vertical fashion and have longitudinally aligned holes for transport of the hot furnace gases.

U.S. Pat. No. 4,900,249 describes a novel approach for stabilizing the critical area on the wall of an aluminum reverberatory furnace. In this patent wall block are positioned standing on end. The working face block is interlocked with the backup block by means of a male projection on the working face block which fits into a corresponding female recess in the backup block. The working face block is thus structurally tied into the backup lining with minimal joints exposed at the working face.

While the prior art has improved wall stability by making advances in the way that brick are interlocked further improvements are desired, especially since metallurgical furnaces and other high temperature vessels are expected to last longer due to the high cost of replacing the linings and the economic need to keep these furnaces and vessels in continuous operation. Wall stability is an especially acute problem in furnaces having long axial construction such as rectangular-shaped nonferrous reverberatory furnaces. These furnaces typically have walls about 30 feet in length. Such walls, without sufficient structural support, tend to bow inward over time thus causing premature failure of the lining.

SUMMARY OF THE INVENTION

This invention provides a means of improving the stability of long refractory walls. It provides a novel approach for anchoring the refractory lining to the furnace shell while accommodating both vertical and horizontal expansion as well as forward and backward movement before buildup of these conditions damage the refractory or the integrity of the wall.

Briefly stated, the present invention comprises a brick for use in a refractory lining in high temperature furnaces, comprising:

a generally rectangular body having top and bottom surfaces;

at least one tongue and groove pair in at least one of said surfaces; and anchor means formed integrally with said body and extending from an end of said body, said anchor means comprising a head and neck with said neck adjacent said body and having a smaller width than said head and body so as to form a channel between said head and said body.

The present invention also comprises a tie-back assembly of at least two of said brick and refractory linings in which said tie-back assemblies are approximately spaced to provide vastly improved structural support for said linings.

BRIEF DESCRIPTION OF THE DRAWINGS

FIG. 1 us a perspective view of a brick of the present invention;

FIG. 2 is a perspective view of a tie-back assembly of the present invention;

FIG. 6(*b*) is an elevational plan view of the clip of FIG. 6(*a*).

DETAILED DESCRIPTION

Figure 3:
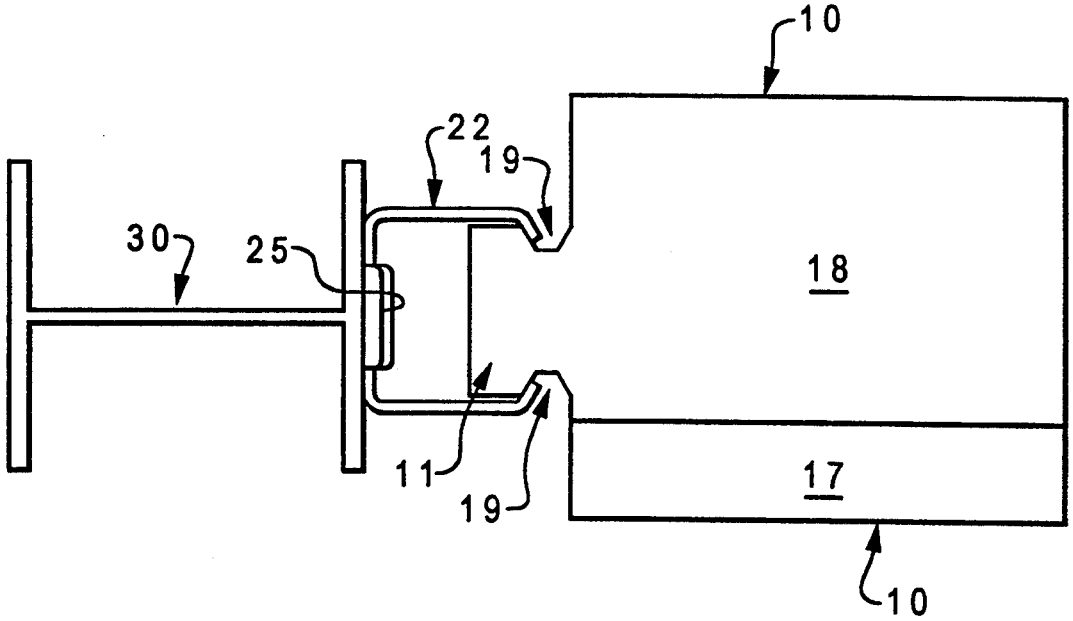
FIG. 3 is a plan view of the assembly of FIG. 2 attached to a furnace wall.

The invention will be further described with reference to the drawings, which show the inventions as practiced with respect to a typical reverberatory furnace.

Referring specifically to FIG. 1, it shows a brick in accord with present invention comprising body portion 10 and anchor portion 11 offset with respect to the center line of body portion 10. The brick has an upper surface 17, in which there is at least one tongue 12 and groove 13 and body portion 10 and offset anchor 11 are joined by neck portion 15. The dimension of the anchor 11 are smaller than that of the body 10 and offset therefrom for reasons discussed below and neck 15 is narrower than head 16 of anchor 11, in order to form channels 19 between shoulders 21 of body portion and head 16. Body portion 10 has the usual side walls 14 and a bottom surface 18 shown in FIG. 2.

It will be understood that the brick can be made of any refractory composition commonly utilized in forming linings in furnaces and they are prepared by having the proper mold into which the refractory mixture is placed and the brick formed either by pressing, casting or other conventional means used to form brick. The brick composition is not critical to the instant invention, other than the fact that it should have the characteristics of strength, heat resistant, and the like properties, commonly required for refractory linings for a wide variety of furnace types employed in high temperature processes; i.e., metallurgical furnaces, incinerators, and the like. The particular size and shape of the tongue and groove arrangement and of channels 19 is not critical, but must be a size and shape sufficient to limit movement of the tie-back brick assembly as hereinafter described.

Moreover, the dimensions of neck 15 are critical only to the extent that the neck must be of a sufficient size to prevent the breaking off of anchor 11 at the neck portion 15 due to the physical stresses and strains which arise due to movement of the lining, as has been discussed, due to the heat in the vessel.

Referring to FIG. 2, there is shown a tie-back assembly 20 comprising at least two brick of the present invention, in which tongue 12 and groove 13 of each of the individual brick body portions are mated. Because the tongue and grooves are offset in each of the brick and the individual brick anchor portions 11 are also offset, the anchor portions 11 of each brick are in alignment when the brick are mated so that the channels 19 of each of the brick are aligned for attachment with clamping means, such as C-shaped clamp 22, and the respective tongues 12 of each brick mate with the grooves 13 of the other brick.

Figure 4:
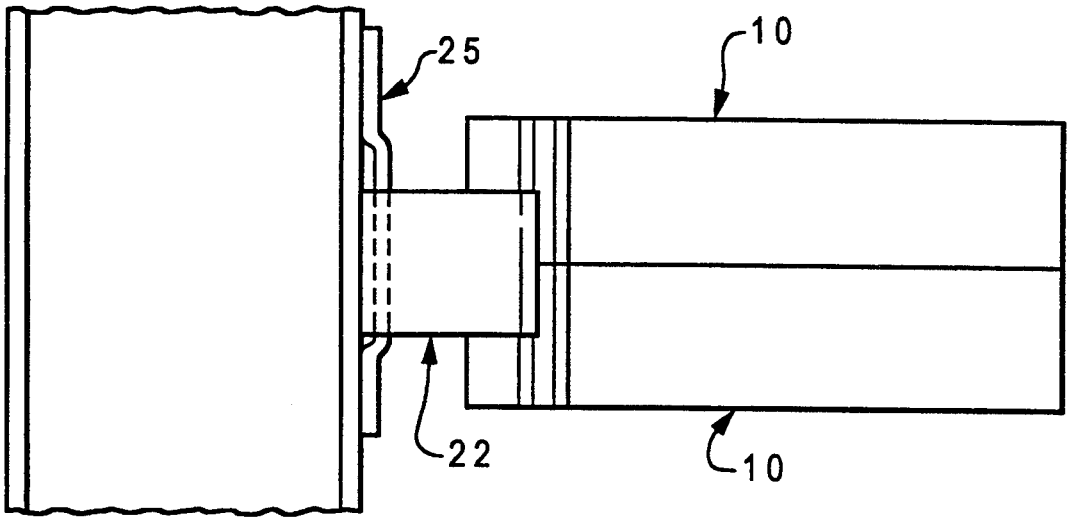
FIG. 4 is an elevational view of the assembly of FIG. 3.

The formation of the tie-back assembly 20 is best shown in FIGS. 3 and 4 in which I-beam 30 is shown. I-beam 30 has fastened thereto, as by welding, means for attaching the assembly thereto, such as U-shaped clip 25, which is more fully described in FIGS. 6(*a*) and 6(*b*). This attachment of clip 25 is carried out after tie-back assembly 20 has been assembled together with clamp 22 with FIG. 4 best showing how the clip 25, when fastened as be welding to the I-beam 30, will act to hold the assembly in place.

Figure 5:
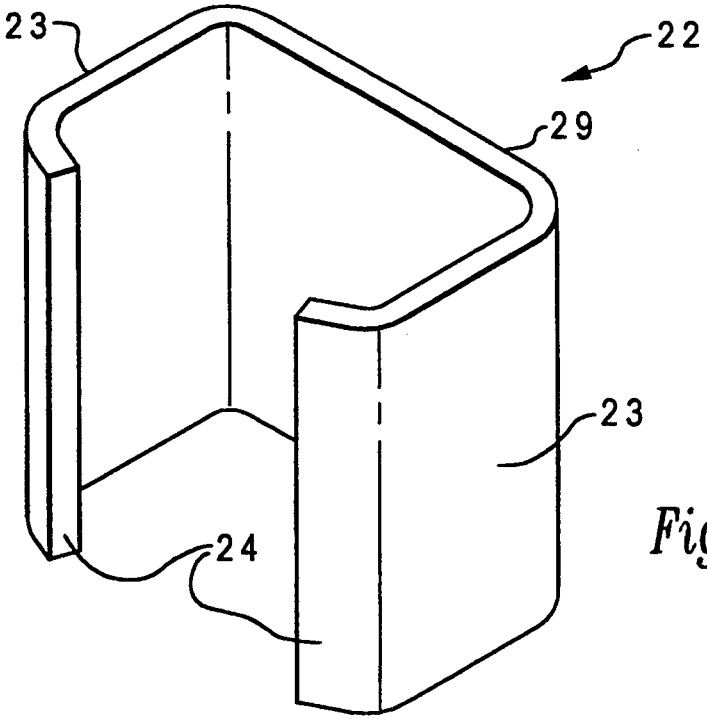
FIG. 5 is a perspective view of a C-shaped clamp utilized in forming a tie-back brick assembly of the present invention.

Clamp 22 is best shown in FIG. 5, and it comprises a body portion 29 having arms 23 extending therefrom and grasping finger portions 24. It is essentially a C-shaped clamp, with fingers 24 sized so as to fit in the channels 19 of the individual brick and thereby hold tie-back assembly 20 in place. Obviously, the length and width of arms 23 are such to insure that fingers 24 will grasp in channels 19 of the brick of the assembly 20.

Figure 6A:
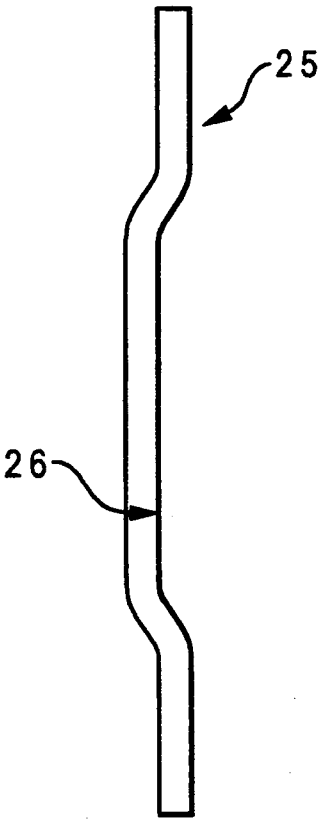
FIG. 6(*a*) shows an elevational side view of a clip for engaging the C-shaped clamp and fastening the clamp to the supporting or enclosing metalwork of a high temperature furnace.
Figure 6B:
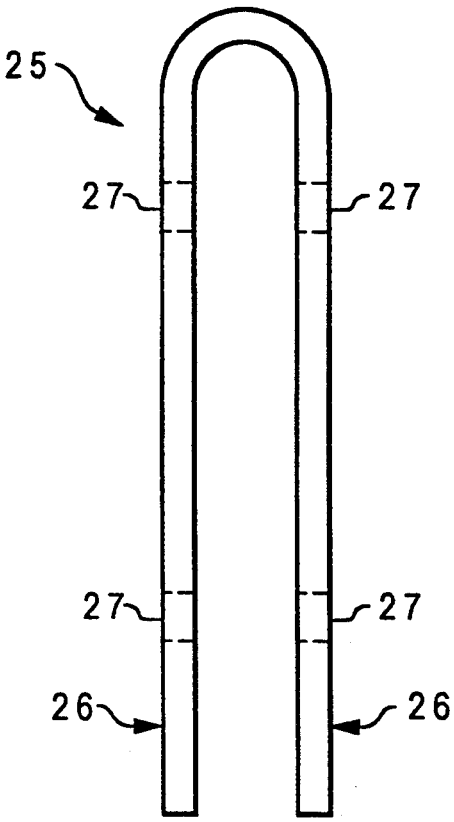

Clip 25 is preferably U-shaped, as shown in FIGS. 6(*a*) and 6(*b*), in order to grasp body portion 29 of C-shaped clamp 22 in several places to insure added strength. Legs 26 of clip 25 are shaped, preferably bowed, as shown in FIG. 6(*a*) to permit insertion of clamp 22 between it and the I-beam support 30. Shown in FIG. 6(*b*) are attachment points 27 by which the clip can be welded to support 30.

Figure 7:
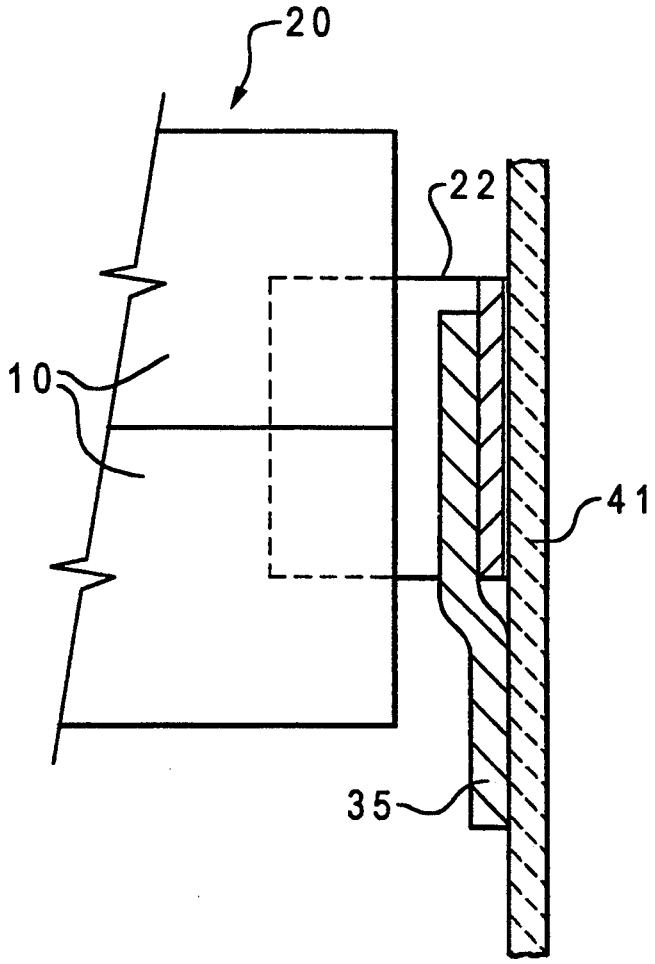
FIG. 7 is a sectional elevational view of an alternate clip for engaging the C-shaped clamp.

Referring to FIG. 7, it shows an alternate embodiment of the invention, in which the tie-back assembly 20 is fastened directly to supporting steelwork or steel enclosure 41 or again to a support, such as I-beam 30, by means of an open ended clip 35. In this embodiment the clip 35 can first be directly welded onto the supporting steelwork 41 of the reverbatory furnace and then the tie-back assembly simply placed thereover without any need to first assemble the tie-back assembly 20 with the clamp 22 onto clip 25 before it is placed onto the furnace wall or support.

Figure 8:
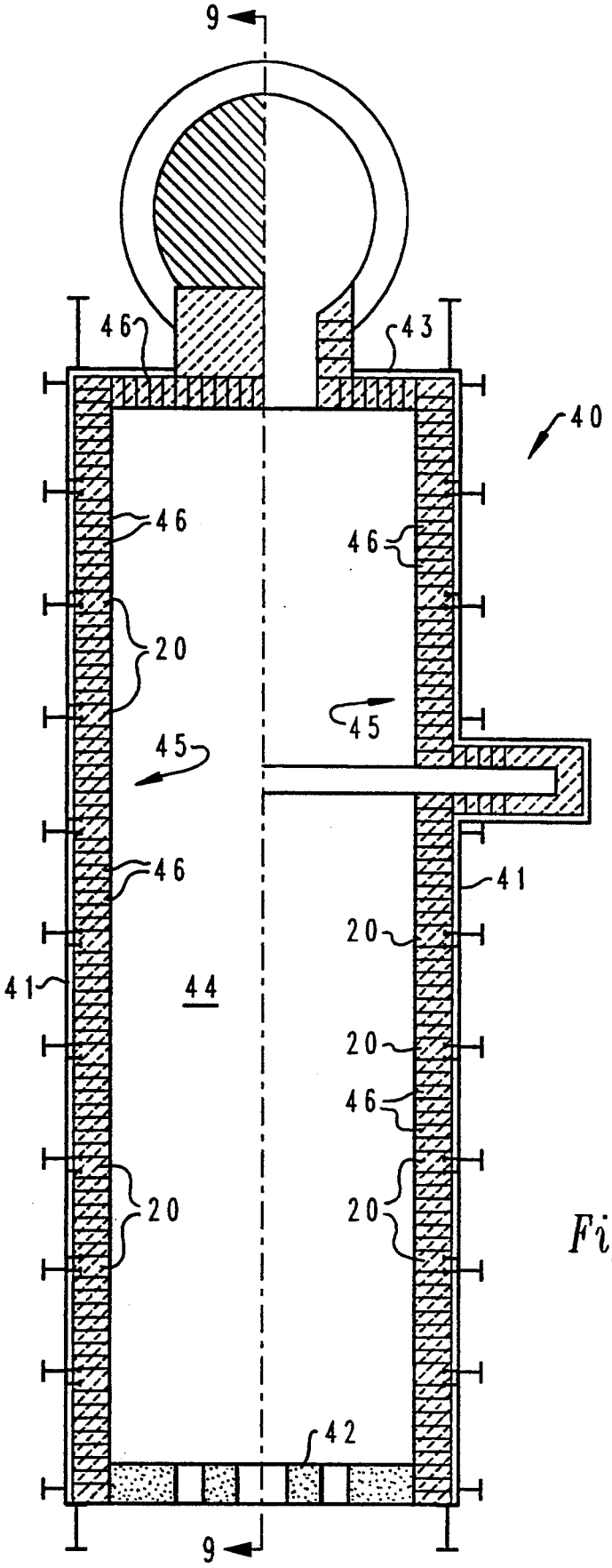
FIG. 8 is a plan view of a furnace with a lining of the present invention.
Figure 9:
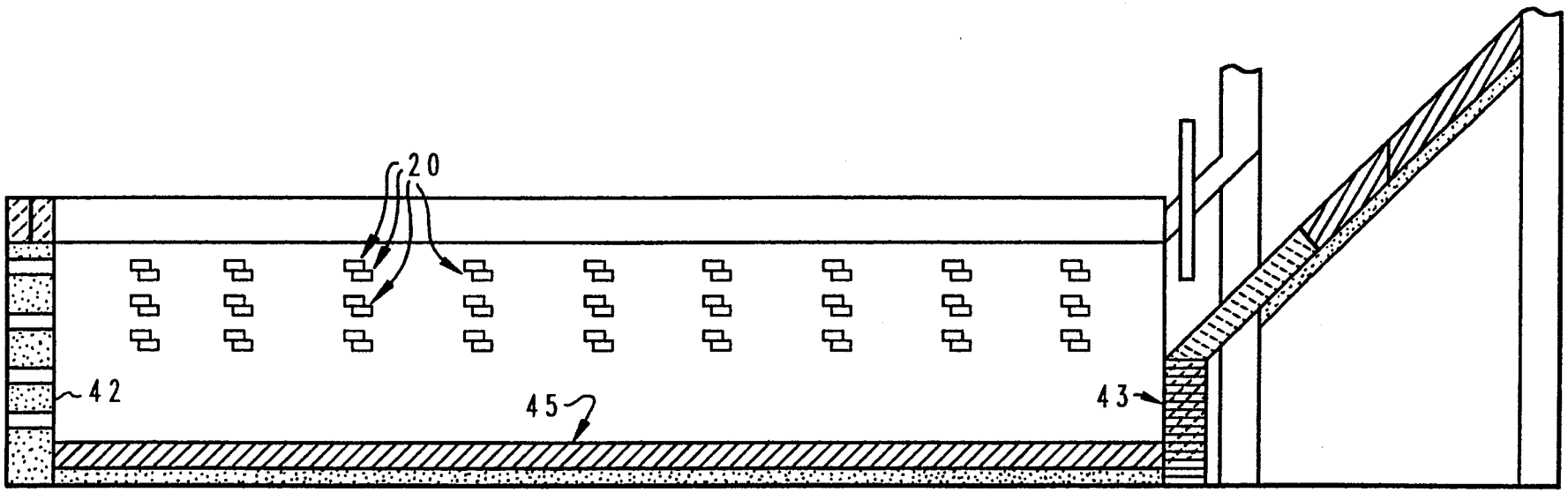
FIG. 9 is a sectional view taken along line 9—9 of FIG. 8 with only the tie-back brick shown on a sidewall.

FIG. 8 shows a typical reverbatory furnace 40, having supporting steelwork 41, end wall 42, intake wall 43, and a bottom 44. Assembled against the supporting steelwork 41 is a refractory lining 45 comprising conventionally shaped bricks 46 having the shape ordinarily utilized for such refractory linings and then spaced throughout the lining 45 are the tie-back assemblies 20 of the present invention. The placement of the tie-back brick assemblies 20 is best shown in FIG. 9 which shown the spacing of the tie-back brick in lining 45. Not shown for ease of understanding are the other brick which are conventionally spaced in lining 46 in contact with assemblies 20. It will be understood that the other brick and the entire lining is assembled using techniques ordinarily employed in such linings.

It will be evident that the clamp 22 is preferably made of steel as are the clips 25 and 35 and the dimensions of the clips are such that they permit vertical movement as the lining expands or contracts. In addition to which the dimensions of channels 19 are such that they will permit horizontal movement of the brick in the tie-back assembly 20 so as to permit both vertical and horizontal movement, as the lining expands and contracts.

In practice, the individual components of the tie-back assembly 20 are simply put together by mating first the individual brick so that tongue 12 and groove 13 of each are mated and then placing the C-clamp 22 thereabout. During construction of the refractory wall 45, the portions where the tie-back assemblies are to be placed are marked on the wall 45 or other support, such as the I-beam 30. If the clip is of the open-ended type 35, then it is simply welded thereto. If it is of the U-shaped type 25, then the welding is carried out after entire tie-back assembly 20 consisting of the two brick and the C-clamp 22 have been assembled and the clamp placed into the bowed portion of the legs 26 of clamp 25. It will be evident that the clips 25 and 35 should be placed perpendicular to the long axis of clamp 22. Any conventional welding can be utilized for this welding purpose.

The brick used in forming the wall are positioned such that the anchor projection at the cold face end of the brick fits into the C-clamp and is centered about mid-point of the height of the C-clip. The top refractory brick is optionally mortared and placed on top of the underlying brick. Conventional brick laying techniques are followed utilizing the conventional brick until the next tie-back assembly brick 20 is required.

It will be evident that the marking to properly locate the tie-back assemblies 20 is routine to those skilled in this art and is dependent upon the dimensions of the furnace walls and size of the brick utilized.

The tie-back assembly 20 described in detail above is unique because it allows for controlled movement of the refractory lining in all dimensions. It allows for growth and distortion in the vertical and horizontal direction as well as backwards with limited forward movement. This provides greater long-term structural stability for wall constructions because any growth or distortion in any three axial directions can be relieved before serious stress levels are formed.

If desired, the tie-back assembly 20, can consist of three brick with the upper and lower brick being shaped as described above and depicted in the drawings. The middle brick will have tongues and grooves in both the upper and lower surfaces to mate with the corresponding tongues and grooves of the upper and lower brick. Also, the anchor of the intermediate brick is not offset with respect to the body portion thereof. In this case the clamp and clip have to be suitably enlarged so as to permit the clamp to clasp all three brick and the clip to be able to engage and hold the enlarged clamp.

In addition, the tie-back assembly of the present invention is more easily located and attached to the furnace shell or other supporting structure compared to the prior art tie-back designs which were more cumbersome to install. More importantly, the metal tie-back clips do not have to be prepositioned on the entire wall as was the case with the prior art. They are positioned when needed during construction of the brick walls. In prior art, when the tie-backs were prepositioned on the supporting wall, proper wall construction was often difficult and had to be compromised to obtain an acceptable fit between the refractory and the prepositioned tie-back.

Another advantage of the present invention is that this new tie-back assembly allows location of expansion joints anywhere in the lining other than at specific locations in the lining as was the case in prior tie-back designs. This allows for earlier release of stress before the stress load from many refractories accumulates to damaging levels.

Thus, it will be appreciated that as a result of the present invention, an improved refractory lining wall construction is provided by which the principal object and others are completely fulfilled.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A brick for use in a refractory lining in high temperature furnaces, comprising:

a generally rectangular body having top and bottom and side surfaces;

at least one tongue and groove pair in one of said top and bottom surfaces, said pair being offset, being closer to one side of said body than to an opposite side; and anchor means formed integrally with said body and extending from an end of said body, said anchor means comprising a head and neck with said neck adjacent said body and having a smaller width than said head and body so as to form channels between said head and said body and said head offset with respect to said body portion.

2. The brick to claim 1, wherein said anchor has top and bottom surfaces that are co-extensive with the top and bottom surfaces of said body and said head is offset with respect to said body.

3. A brick assembly for use in a refractory lining in high temperature furnaces, comprising:

at least a first and second stacked brick, each brick having a body portion, a tongue and groove pair in one surface of said body, the tongue of said first brick mating with the groove of said second brick, and the tongue of said second brick mating with the groove in said first brick, the tongue and groove pair in each brick being offset to one edge of the body thereof;

an integrally formed anchor extending from the body of each brick, said anchors each having a head and neck being in alignment with each other and each anchor head being offset with respect to said body portion and having a reduced neck portion adjacent each said body when compared with the dimension of said extension not adjacent to said body; and clamping means loosely engaging the neck portion of each brick to hold the staked pair of bricks together and in alignment.

4. The brick assembly according to claim 3, wherein said clamping means is C-shaped, having two curved ends and a substantially flat central portion.

5. A lining for us in high temperature furnaces comprising refractory brick interspersed with a plurality of brick assemblies of claim 3, each brick assembly of said plurality being affixed to a surface of said furnace.

6. The lining of claim 5 wherein clip means attached to said surface of said furnace engage the clamping means of said brick assemblies to affix said assemblies to said surface.

7. The lining of claim 6 wherein the brick assemblies comprise:

at least a first and second stacked brick, each brick having a body portion, a tongue and groove pair in one surface of said body, the tongue of said first brick mating with the groove of said second brick, and the tongue of said second brick mating with the groove in said first brick, the tongue and groove pair in each brick being offset to one edge of the body thereof;

an integrally formed anchor extending from the body of each brick, said anchors each having a head and neck being in alignment with each other and each anchor head being offset with respect to said body portion and having a reduced neck portion adjacent each said body when compared with the dimension of said extension not adjacent to said body; and clamping means loosely engaging the neck portion of each brick to hold the stacked pair of bricks together and in alignment.

8. The lining of claim 6 wherein the brick assemblies comprise:

at least a first and second stacked brick, each brick having a body portion, a tongue and groove pair in one surface of said body, the tongue of said first brick mating with the groove of said second brick, and the tongue of said second brick mating with the groove in said first brick, the tongue and groove pair in each brick being offset to one edge of the body thereof;

an integrally formed anchor extending from the body of each brick, said anchors each having a head and neck being in alignment with each other and each anchor head being offset with respect to said body portion and having a reduced neck portion adjacent each said body when compared with the dimension of said extension not adjacent to said body; and C-shaped clamping means having two curved ends and a substantially flat central portion loosely engaging the neck portion of each brick to hold the stacked pair of bricks together and in alignment.

* * * * *